United States Patent [19]

Ledley

[11] 4,344,013

[45] Aug. 10, 1982

[54] MICROFOCUS X-RAY TUBE

[76] Inventor: Robert S. Ledley, 1022 Lagrande Rd., Silver Spring, Md. 20903

[21] Appl. No.: 286,827

[22] Filed: Jul. 27, 1981

Related U.S. Application Data

[63] Continuation-in-part of Ser. No. 87,374, Oct. 23, 1979, Pat. No. 4,281,269, which is a continuation-in-part of Ser. No. 791,328, Apr. 27, 1977, abandoned.

[51] Int. Cl.[3] ..... H01J 35/08

[52] U.S. Cl. ..... 313/60; 313/330

[58] Field of Search ..... 313/60, 330

[56] References Cited

U.S. PATENT DOCUMENTS

| | | | |
|---|---|---|---|
| 2,298,335 | 10/1942 | Atlee | 313/330 |
| 3,290,540 | 12/1966 | Atti | 313/146 |
| 3,753,020 | 8/1973 | Zingaro | 313/60 |
| 3,825,786 | 7/1974 | Einighammer et al. | 313/60 |
| 3,836,804 | 9/1974 | Frens et al. | 313/60 |

FOREIGN PATENT DOCUMENTS

| | | |
|---|---|---|
| 1232160 | 5/1971 | United Kingdom . |
| 1436872 | 5/1976 | United Kingdom . |
| 1505587 | 3/1978 | United Kingdom . |

*Primary Examiner*—David C. Nelms
*Assistant Examiner*—Darwin R. Hostetter
*Attorney, Agent, or Firm*—John J. Byrne

[57] ABSTRACT

Disclosed is a reusable microfocus X-ray tube adapted to generate a relatively large number of X-rays in a relatively short period of time using a narrowly focused electron beam. The X-ray tube comprises means for producing a dense, narrow electron beam, a target anode, and means for causing relative movement of the electron beam and the target anode such that the electron beam and the target anode are stationary relative to each other during production of the X-rays but a fresh portion of the surface of the target anode is presented to the electron beam each time the X-ray tube is used. The X-ray tube includes (a) means for collecting charged particles boiled off the target anode by the electron beam, (b) means for increasing the quantity of electricity delivered to the heater cathode, (c) means for counting the number of times the X-ray tube is used, and (d) means for generating a signal when the X-ray tube has been used a first predetermined number of times.

32 Claims, 3 Drawing Figures

MICROFOCUS X-RAY TUBE

CROSS-REFERENCE TO RELATED APPLICATIONS

This application is a continuation-in-part of application Ser. No. 06/087,374 filed Oct. 23, 1979, now U.S. Pat. No. 4,281,269, issued July 28, 1981. That application was in turn a continuation-in-part of application Ser. No. 791,328, filed Apr. 27, 1977, and abandoned upon the filing of that application.

BACKGROUND OF THE INVENTION

This invention relates to microfocus X-ray tubes such as are used to take medical X-rays. In such X-ray tubes, the electron beam is focused on an extremely small point on the target, which has the medical advantage that the X-ray silhouette is very clear and crisp. However, the highly dense, small spot of electrons quickly melts the target no matter what kind of cooling device is used, and therefore either the X-ray target is consumed in one use or fewer electrons are used in the beam than would otherwise be desirable. In particular, it is highly desirable in medical X-ray work to use an extremely short exposure time so that the motion of the patient or of the patient's inside organs does not smear the picture. However, with prior-art microfocus tubes, the exposure time must be relatively long to get enough X-rays to form the picture because the rate of X-ray production is so small.

The problems suggested in the preceding prargraphs are not intended to be exhaustive, but rather are among many which tend to reduce the effectiveness of prior-art microfocus X-ray tubes. Other noteworthy problems may also exist; however, those presented above should be sufficient to demonstrate that microfocus X-ray tubes appearing in the prior art have not been altogether satisfactory.

OBJECTS OF THE INVENTION

It is, therefore, a general object of the invention to provide a microfocus X-ray tube which will obviate or minimize problems of the type previously described.

It is a particular object of the invention to provide such a device which is reusable, yet which generates a relatively large number of X-rays in a relatively short period of time using a narrowly focused electron beam.

It is a further object of the invention to provide a microfocus X-ray tube wherein the X-ray tube comprises means for causing relative movement of the electron beam and the target anode such that the electron beam and the target anode are stationary relative to each other during the production of X-rays but a fresh portion of the surface of the target anode is presented to the electron beam each time the X-ray tube is used.

It is another object of the invention to provide a microfocus X-ray tube which includes means for collecting charged particles boiled off the target anode by the electron beam.

It is still a further object of the invention to provide a microfocus X-ray tube which is made substitutable for a conventional microfocus X-ray tube by the provision of means for increasing the quantity of electricity delivered to the heater cathode so that the total number of X-rays produced by the X-ray tube is at least approximately equal to the total number of X-rays which would be produced by a conventional microfocus X-ray tube receiving the same actuating signal.

It is still another object of the invention to provide a reusable microfocus X-ray tube with means for counting the number of times the X-ray tube has been used and means for generating a first signal when the X-ray tube has been used a first predetermined number of times, whereby the operator is warned that the X-ray tube or the target anode in the X-ray tube must soon be replaced.

It is yet another object of the invention to provide a reusable microfocus X-ray tube with means for generating a second signal when the X-ray tube has been used an additional number of times, whereby the operator is warned that the X-ray tube or the target anode in the X-ray tube must be replaced immediately.

It is still a further object of the invention to provide a reusable microfocus X-ray tube with means for detecting when the target anode has been consumed and means for generating a second signal when the target anode has been consumed.

It is yet another object of the invention to provide a reusable microfocus X-ray tube wherein the means for causing relative movement of the electron beam and the target anode ensures that the portions of the target anode consumed by successive uses of the X-ray tube are not adjacent to one another.

It is still a further object of the invention to provide a reusable microfocus X-ray tube wherein the means for causing relative movement of the electron beam and the target anode may be either inside or outside the evacuated envelope of the X-ray tube.

It is still another object of the invention to provide a reusable microfocus X-ray tube wherein the portion of the evacuated envelope through which the X-rays emerge is made of conducting glass, whereby that portion can be given a charge which repels charged particles boiled off the target anode by the electron beam.

Finally, it is a particular object of the invention to provide a reusable microfocus X-ray tube wherein the means for causing relative movement of the electron beam and the target anode causes motion of the electron beam rather than the target anode.

Other objects and advantages of the present invention will become apparent from the detailed description of a preferred embodiment given hereinafter taken in conjunction with the accompanying drawings.

DESCRIPTION OF THE PRIOR ART

Many X-ray tubes of the type used in taking medical X-rays are known which employ more or less elaborate devices to move the target anode during impingement of the electron beam, thereby distributing the heat generated by the electron beam over a portion of the surface of the target anode far in excess of the cross-sectional area of the electron beam. Representative of the awkward designs others skilled in the art have resorted to remove and deconcentrate the heat generated by the action of the electron beam on the target material is the device disclosed in U.S. Pat. No. 3,825,786, issued July 23, 1974, to Einighammer et al.

Many other X-ray tubes of the type used in taking medical X-rays are known in which similarly elaborate devices are employed to bring a cooling fluid into thermal contact with the target anode during impingement of the electron beam. The cooling fluid may, for example, be water or air.

Other types of X-ray tubes not suitable for use in taking medical X-rays, but suitable for use in X-ray crystallography, are known in which the target anode can be moved between impingements of the electron beam. Typical of these are the devices shown in U.S. Pat. No. 2,298,335, issued Oct. 13, 1942, to Atlee, and U.S. Pat. No. 3,753,020, issued Aug. 4, 1973 to Zingaro. Such devices, however, include a plurality of separate target anodes made of different materials, and the devices permit the operator to alternate from one target anode to another to obtain different readings from the different types of anodes. However, they do not cause the automatic substitution of one target anode for another after each use, and the operator could (and in many cases would) use the same segment of the same target anode many times before switching to a different target anode. Moreover, devices such as are disclosed in Atlee and Zingaro do not cause a different portion of each target anode to be used each time the user returns to a given target anode. If a fresh portion of the target anode is presented to the electron beam when a given target anode is used on a subsequent occasion, it would be accidental or incidental, not caused deliberately and consistently.

Finally, U.S. Pat. No. 3,290,540, issued Dec. 6, 1966, discloses an electron discharge tube having a movable cathode tape. The tape serves as an emissive element, and the tape can be incremented after it has become pitted from use. However, the pitting of an emissive cathode from use is very different, both physically and conceptually, from the melting of a portion of a target anode due to the impingement of an electron beam.

THE DRAWINGS

DETAILED DESCRIPTION OF A FIRST EMBODIMENT

Figure 1:
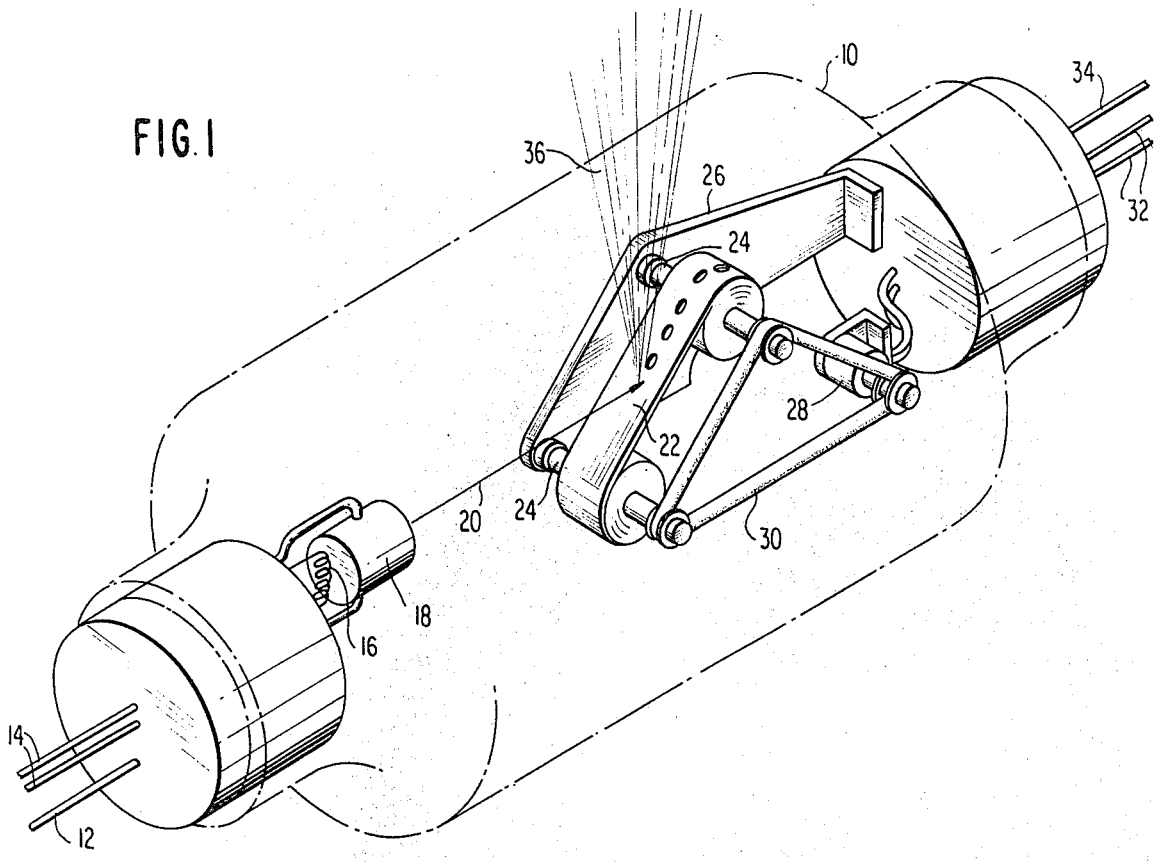
FIG. 1 is a perspective view of a first embodiment of an X-ray tube according to this invention.

The first embodiment of the subject invention comprises a conventional evacuated glass envelope and a high voltage line 12, filament current wires 14, a heater cathode 16, and an electron beam collimator 18 which together constitute means for producing a dense, narrow electron beam 20. Instead of the conventional conical target anode, however, the subject X-ray tube preferably has a target anode in the form of a ribbon 22 trained around two spools 24 mounted within the X-ray tube on bracket 26. The ribbon 22 is preferably made of tungsten, but in any event the working surface of the ribbon 22 is made of a single anode material.

Also mounted within the X-ray tube is a stepping motor 28 which is operatively connected to the spools 24 via a drive belt 30. Power for the motor 28 is supplied by motor wires 32, and the motor 28 of the target anode 22 are grounded by ground wire 34.

The roughened portions of the ribbon 22 caused by impingement of the electron beam 20 are, of course, greatly exaggeraged in size for clarity. In fact, the roughened portions are approximately 50 microns in diameter, and their center-to-center distance (i.e., the amount by which the stepping motor 28 increments the ribbon 22 each time it is actuated) is approximately 100 microns.

In use, activation of the heater cathode 16 and the motor 28 is coordinated so that the ribbon 22 is stationary during production of X-rays 36, but a fresh portion of the surface of the ribbon 22 is presented to the electron beam 20 each time the X-ray tube is used. Each use of the X-ray tube therefore melts at least the surface portion of the spot on the ribbon 22 on which the electron beam 20 is focused, but the ribbon 22 is then moved on by a short distance, much in the fashion of a typewriter ribbon, before the X-ray tube is used again.

Figure 2:
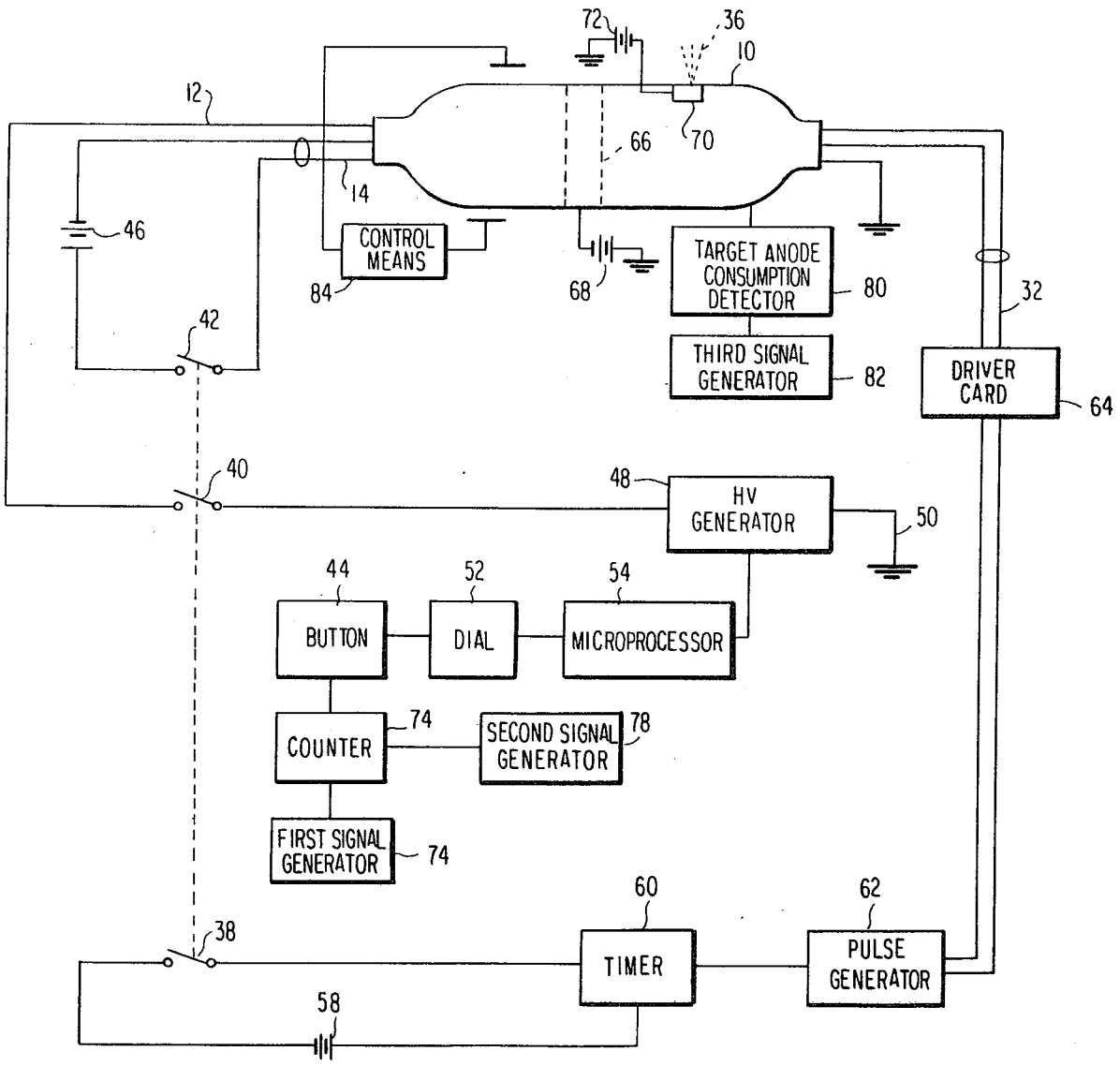
FIG. 2 is a schematic diagram of control means for the X-ray tube shown in FIG. 1.

FIG. 2 shows in schematic form exemplary means for coordinating the electron producing means and the ribbon advancing means. Such means comprise three ganged switches 38, 40, and 42 and three circuits, one of which is controlled by each of the switches. The ganged switches may be operated simultaneously by a single push button 44. One of the three circuits comprises a voltage source 46, the switch 42, and the filament current wires 14. Another of the three circuits comprises a high voltage generator 48 grounded at 50, the switch 40, and the high voltage line 12.

A dial 52 is provided which is settable by the operator to a selected time period for which the electron beam 20 is to be produced. The dial 52 is calibrated for values which would be used if the microfocus X-ray tube were a conventional microfocus X-ray tube having a target anode which is moved and/or cooled during use. However, since the target anode 22 is neither moved or cooled during use, some of the energy in the electron beam 20 is used melting the target anode. Accordingly, more electricity (conventionally measured in milliamp-seconds) must be provided to the heater cathode 16 to produce the same amount of X-rays. In the illustrated embodiment this is accomplished by a microprocessor 54. The microprocessor 54 preferably calculates an electrical current value sufficiently higher than the current value which otherwise would be supplied to the heater cathode 16 so that the total number of X-rays produced by the X-ray tube is at least approximately equal to the total number of X-rays which would be produced by a conventional microfocus tube receiving the same actuating signal from the button 44 and the dial 52. That value is then communicated to the high voltage generator 48, which supplies the calculated amount of electricity to the heater cathode 16. Alternately, the length of time for which the usual electric current is supplied to the heater cathode 16 could be increased correspondingly. However, that solution is not preferred because it is desired to minimize the time period during which the electron beam 20 is on.

The third circuit is the circuit which coordinates the first two circuits and the stepping motor 28. It comprises the switch 38, a battery 58 (which may be the same as battery 44), a timer 60, which may for instance be a two-second timer, a pulse generator 62, a driver card 64, and motor wires 32.

Actuation of the ganged switches 40 and 42 causes generation of an electron beam lasting less than 1/10 of a second. Simultaneously, actuation of the switch 38 actuates the two-second timer 60. After elapse of the two seconds, the pulse generator 62 emits a pulse which actuates the driver card 64, and the driver card 64 causes the stepping motor 28 to increment. The increment of the stepping motor 28 may, for instance, be 1.8°, and the spools 24 and the take-off spool connected to the stepping motor 28 are sized so that a 1.8° increment of the stepping motor causes the ribbon 22 to advance by approximately 100 microns. Since the time elapse between X-rays is much more than two seconds, the illustrated apparatus insures that a fresh portion of the surface of the ribbon 22 is presented to the electron beam upon each actuation of beam.

FIG. 2 also shows a conductive band 66 mounted inside the envelope 10 and connected to a battery 68 (which may be the same as battery 46). The conductive band 66 (or any other internal collector means) is given a charge opposite to the charge on the charged particles boiled off the target anode 22 by the electron beam 20, and it accordingly serves as a means for collecting those particles and preventing them from being deposited elsewhere within the envelope 10.

Similarly, FIG. 2 shows a portion 70 of the evacuated envelope through which the X-rays 36 emerge. The portion 70 is made of conducting glass which is connected to a battery 72 (which may be the same as the battery 46). The portion 70 is given a charge which is the same as the charge on the charged particles boiled off the target anode 22 by the electron beam 20, and it accordingly serves to repel those charged particles, ensuring that they are not deposited on the portion 70, where they would cause secondary emissions.

FIG. 2 also shows a counter 74 actuated by depression of the button 44. The counter 74 serves to count the number of times the microfocus X-ray tube has been used. The counter 74 is connected to a first signal generator 76 which generates a first signal (for instance, an amber light) when the X-ray tube has been used a first predetermined number of times (for instance, 95 percent of the calculated maximum number of uses). The counter 74 may also be connected to a second signal generator 78 which generates a second signal (for instance, a red light) when the X-ray tube has been used a second predetermined number of times (for instance, 99 percent of the calculated maximum number of uses). Alternatively, means 80 may be provided to detect when the target anode 22 has been consumed (for instance, the detector means 80 may sense an increase in tension in the tape 22, as at the end of a typewriter ribbon), and the detector means 80 can be connected to a signal generator 82 which generates a signal (for instance, a red light) when the detector 80 detects consumption of the target anode 22.

Although the use of a simple linear stepping motor 28 is within the contemplation of the invention, it may be desirable to use a more complex drive motor. Specifically, it may be undesirable to have the portions of the target anode 22 consumed by successive uses of the X-ray tube adjacent to one another, since the temperature of the target anode adjacent to a portion which has been melted may still be elevated when it is desired to use the microfocus X-ray tube again. Accordingly, it may be desirable to design the motor 28 so that it causes the target anode to move such that the portion of the target anode consumed by successive uses of the X-ray tube are not adjacent to one another. This may be accomplished, for instance, by use of a back-and-forth linear movement or by use of a two-dimensional, matrix movement.

Although FIG. 1 shows the motor 28 mounted internally of the evacuated envelope 10, it is to be clearly understood that the motor 28 could be mounted externally of the envelope 10 and that physical means extending through the envelope 10 could connect the motor 28 to the drive belt 30. Alternatively, an exterior magnetic source could be used to move the target anode 22 through the envelope 10 without having to extend physical means through the envelope 10.

Finally, it is to be understood that the target anode 28 need not move at all. What is important is that there be relative movement between the target anode 28 and the electron beam 20. This can be accomplished by movement of the target anode 28, but it can also be accomplished by movement of the electron beam 20, or by a combination of movement of the target anode and the electron beam. Movement of the electron beam 20 can be accomplished, for instance, by use of electron beam control means 84 such as are conventionally used in television sets. Such control means 84 can be used to cause the portion of the target anode 22 melted on each successive use of the microfocus X-ray tube to increment in any selected pattern.

DETAILED DESCRIPTION OF A SECOND EMBODIMENT

Figure 3:
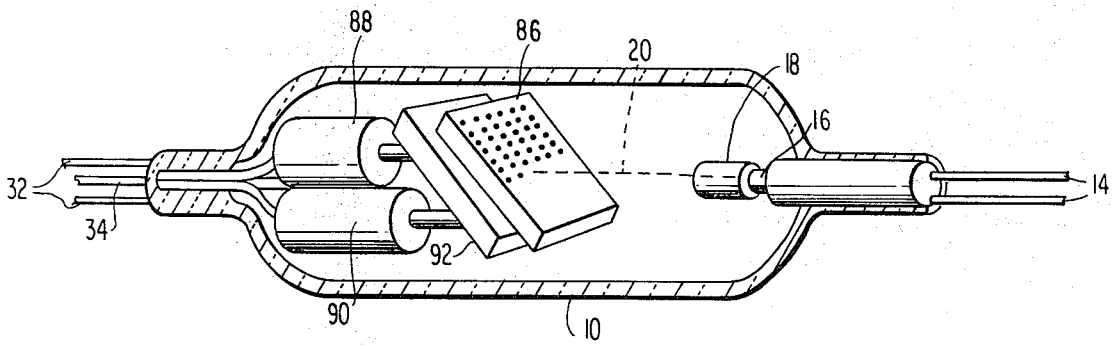
FIG. 3 is a perspective view of another embodiment of an X-ray tube according to this invention.

A second embodiment of the subject invention is shown in FIG. 3. It is generally similar to the first embodiment, and the same numbers are used to indicate parts which are the same as in the first embodiment.

It is within the contemplation of this invention for the target anode to take on many shapes other than the ribbon shape shown in FIG. 1. It may, for instance, be in the shape of a wheel or a cone. Additionally, a rectangular shape such as the rectangular anode 86 shown in FIG. 3 may be used. In that case, motion of the anode 86 may be controlled in conventional fashion by an x-motor 88 and a y-motor 90 which control the position of an x-y table to which the replaceable target anode 86 is connected.

ADVANTAGES OF THE INVENTION

From the foregoing description of a microfocus X-ray tube in accordance with a preferred embodiment of the invention, those skilled in the art will recognize several advantages which singularly distinguish the subject invention from previously known devices. Some of these advantages are set forth below. However, while the following list of advantages is believed to be both accurate and representative, it does not purport to be exhaustive.

A particular advantage of the subject invention is that it is reusable, yet it generates a relatively large number of X-rays in a relatively short period of time from a narrowly focused electron beam.

Another advantage of the subject invention is that it produces X-ray silhouettes which are very clear and crisp. In particular, since the X-ray silhouettes are made in a short time-exposure, motion of the patient's organs does not smear the picture.

CAVEAT

While the present invention has been illustrated by a detailed description of a preferred embodiment thereof, it will be obvious to those skilled in the art that various changes in form and detail can be made therein without departing from the true scope of the invention. Accordingly, the invention must be measured by the claims appended hereto and not by the foregoing preferred embodiment.

It is claimed:

1. In a reusable microfocus X-ray tube adapted to generate a relatively large number of X-rays in a relatively short period of time using a narrowly focused electron beam, said microfocus X-ray tube comprising:

(a) first means for producing a dense, narrow electron beam;
(b) a target anode; and
(c) second means for moving said target anode so that it is stationary during production of X-rays but a fresh portion of the surface of said target anode is presented to the electron beam each time the X-ray tube is used, the improvement wherein said X-ray tube further comprises:
(d) third means for collecting charged particles boiled off said target anode by the electron beam.

2. In a reusable microfocus X-ray tube adapted to generate a relatively large number of X-rays in a relatively short period of time using a narrowly focused electron beam, said microfocus X-ray tube comprising:
(a) first means for producing a dense, narrow electron beam for a preselected period of time upon receipt of an actuating signal;
(b) a target anode; and
(c) second means for moving said target anode so that it is stationary during production of X-rays but a fresh portion of the surface of said target anode is presented to the electron beam each time the X-ray tube is used, the improvement wherein said X-ray tube further comprises:
(d) fourth means for increasing the quantity of electricity delivered to said first means so that the total number of X-rays produced by the X-ray tube is at least approximately equal to the total number of X-rays which would be produced by a conventional microfocus X-ray tube receiving the same actuating signal.

3. In a reusable microfocus X-ray tube as recited in claim 2, the further improvment wherein said fourth means causes a higher current value to be supplied to said first means.

4. In a reusable microfocus X-ray tube adapted to generate a relatively large number of X-rays in a relatively short period of time using a narrowly focused electron beam, said microfocus X-ray tube comprising:
(a) first means for producing a dense, narrow electron beam;
(b) a target anode; and
(c) second means for moving said target anode so that it is stationary during production of X-rays but a fresh portion of the surface of said target anode is presented to the electron beam each time the X-ray tube is used, the improvement wherein the microfocus X-ray tube further comprises:
(d) fifth means for counting the number of times the X-ray tube has been used and
(e) sixth means for generating a first signal when the X-ray tube has been used a first predetermined number of times.

5. In a reusable microfocus X-ray tube as recited in claim 4, the further improvement comprising seventh means for generating a second signal when the X-ray tube has been used a second predetermined number of times, which second predetermined number of times is greater than the first predetermined number of times.

6. In a reusable microfocus X-ray tube as recited in claim 4, the further improvement comprising:
(a) eighth means for detecting when said target anode has been consumed and
(b) ninth means for generating a second signal when said target anode has been consumed.

7. In a reusable microfocus X-ray tube adapted to generate a relatively large number of X-rays in a relatively short period of time using a narrowly focused electron beam, said microfocus X-ray tube comprising:
(a) first means for producing a dense, narrow electron beam;
(b) a target anode; and
(c) second means for moving said target anode so that it is stationary during production of X-rays but a fresh portion of the surface of said target anode is presented to the electron beam each time the X-ray tube is used, the improvement wherein said second means causes said target anode to move such that the portions of said target anode consumed by successive uses of the X-ray tube are not adjacent to one another.

8. In a reusable microfocus X-ray tube adapted to generate a relatively large number of X-rays in a relatively short period of time using a narrowly focused electron beam, said microfocus X-ray tube comprising:
(a) first means for producing a dense, narrow electron beam;
(b) a target anode; and
(c) second means for moving said target anode so that it is stationary during production of X-rays but a fresh portion of the surface of said target anode is presented to the electron beam each time the X-ray tube is used, the improvement wherein:
(d) the X-ray tube comprises an evacuated envelope;
(e) said second means comprises a motor; and
(f) said motor is located externally of said evacuated envelope.

9. In a reusable microfocus X-ray tube adapted to generate a relatively large number of X-rays in a relatively short period of time using a narrowly focused electron beam, said microfocus X-ray tube comprising:
(a) first means for producing a dense, narrow electron beam;
(b) a target anode; and
(c) second means for moving said target anode so that it is stationary during production of X-rays but a fresh portion of the surface of said target anode is presented to the electron beam each time the X-ray tube is used, the improvement wherein:
(d) the X-ray tube comprises an evacuated envelope;
(e) said second means comprises a motor; and
(f) said motor is located internally of said evacuated envelope.

10. In a reusable microfocus X-ray tube adapted to generate a relatively large number of X-rays in a relatively short period of time using a narrowly focused electron beam, said microfocus X-ray tube comprising:
(a) first means for producing a dense, narrow electron beam;
(b) a target anode; and
(c) second means for moving said target anode so that it is stationary during production of X-rays but a fresh portion of the surface of said target anode is presented to the electron beam each time the X-ray tube is used, the improvement wherein:
(d) the X-ray tube comprises an evacuated envelope and
(e) the portion of said evacuated envelope through which the X-rays emerge is made of conducting glass, whereby said portion can be given a charge which repels charged particles boiled off said target anode by the electron beam.

11. In a reusable microfocus X-ray tube adapted to generate a relatively large number of X-rays in a relatively short period of time using a narrowly focused electron beam, said microfocus X-ray tube comprising:

(a) first means for producing a dense, narrow electron beam;

(b) a target anode; and (c) second means for causing relative movement of the electron beam and said target anode such that the electron beam and said target anode are stationary relative to each other during production of X-rays but a fresh portion of the surface of said target anode is presented to the electron beam each time the X-ray tube is used, the improvement wherein said second means causes motion of the electron beam.

12. In a reusable microfocus X-ray tube as recited in claim 11, the further improvement comprising third means for collecting charged particles boiled off said target anode by the electron beam.

13. In a reusable microfocus X-ray tube as recited in claim 11 wherein said first means produces a dense, narrow electron beam for a preselected period of time upon receipt of an actuating signal, the further improvement comprising fourth means for increasing the quantity of electricity delivered to said first means so that the total number of X-rays produced by the X-ray tube is at least approximately equal to the total number of X-rays which would be produced by a conventional microfocus X-ray tube receiving the same actuating signal.

14. In a reusable microfocus X-ray tube as recited in claim 13, the further improvement wherein said fourth means causes a higher current value to be supplied to said first means.

15. In a reusable microfocus X-ray tube as recited in claim 11, the further improvement wherein the microfocus X-ray tube further comprises:

(a) fifth means for counting the number of times the X-ray tubes has been used and (b) sixth means for generating a first signal when the X-ray tube has been used a first predetermined number of times.

16. In a reusable microfocus X-ray tube as recited in claim 15, the further improvement comprising seventh means for generating a second signal when the X-ray tube has been used for a second predetermined number of times, which second predetermined number of times is greater than the first predetermined number of times.

17. In a reusable microfocus X-ray tube as recited in claim 15, the further improvement comprising:

(a) eighth means for detecting when said target anode has been consumed and (b) ninth means for generating a second signal when said target anode has been consumed.

18. In a reusable microfocus X-ray tube as recited in claim 11, the further improvement wherein said second means causes said targed anode to move such that the portion of said target anode consumed by successive uses of the X-ray tube are not adjacent to one another.

19. In a reusable microfocus X-ray tube as recited in claim 11, the further improvement wherein:

(a) the X-ray tube comprises an evacuated envelope;

(b) said second means comprises a motor; and (c) said motor is located externally of said evacuated envelope.

20. In reusable microfocus X-ray tube as recited in claim 11, the further improvement wherein:

(a) the X-ray tube comprises an evacuated envelope;

(b) said second means comprises a motor; and (c) said motor is located internally of said evacuated envelope.

21. In a reusable microfocus X-ray tube as recited in claim 11, the further improvement wherein:

(a) the X-ray tube comprises an evacuated envelope and (b) the portion of said evacuated envelope through which the X-rays emerge is made of conducting glass, whereby said portion can be given a charge which repels charged particles boiled off said target anode by the electron beam.

22. In an X-ray machine comprising:

(a) a microfocus X-ray tube adapted to generate a relatively large number of X-rays in a relatively short period of time using a narrowly focused electron beam and (b) first means for supplying power to said microfocus X-ray tube for a period of time controllable by the operator of the X-ray machine, said microfocus X-ray tube comprising:

(c) second means for producing a dense, narrow electron beam while power is being supplied to said microfocus X-ray tube;

(d) a target anode; and (e) third means for moving said target anode so that it is stationary during production of X-rays but a fresh portion of the surface of said target area is presented to the electron beam each time the X-ray tube is used, the improvement wherein said X-ray tube further comprises:

(f) fourth means for increasing the quantity of electricity delivered by said first means to said microfocus X-ray tube so that the total number of X-rays produced by said microfocus X-ray tube is at least approximately equal to the total number of X-rays which would be produced by a conventional microfocus X-ray tube when said first means was set for a given time period by the operator of the X-ray machine.

23. In an X-ray machine as recited in claim 22, the further improvement wherein said fourth means causes a higher current value to be supplied by said first means.

24. In an X-ray machine comprising:

(a) a microfocus X-ray tube adapted to generate a relatively large number of X-rays in a relatively short period of time using a narrowly focused electron beam and (b) first means for supplying power to said microfocus X-ray tube for a period of time controllable by the operator of the X-ray machine, said microfocus X-ray tube comprising:

(c) second means for producing a dense, narrow electron beam while power is being supplied to said microfocus X-ray tube;

(d) a target anode; and (e) third means for moving said target anode so that it is stationary during production of X-rays but a fresh portion of the surface of said target area is presented to the electron beam each time the X-ray tube is used, the further improvement wherein the X-ray machine further comprises:

(f) fifth means for counting the number of times said X-ray tube has been used and (g) sixth means for generating a first signal when said X-ray tube has been used a predetermined number of times.

25. In an X-ray machine as recited in claim 24, the further improvement comprising seventh means for generating a second signal when said X-ray tube has been used a second predetermined number of times, which second predetermined number of times is greater than the first predetermined number of times.

26. In an X-ray machine as recited in claim 24, the further improvement comprising:

(a) eighth means for detecting when said target anode has been consumed and (b) ninth means for generating a second signal when said target anode has been consumed.

27. In an X-ray machine comprising:

(a) a microfocus X-ray tube adapted to generate a relatively large number of X-rays in a relatively short period of time a narrowly focused electron beam and (b) first means for supplying power to said microfocus X-ray tube for a period of time controllable by the operator of the X-ray machine, said microfocus X-ray tube comprising:

(c) second means for producing a dense, narrow electron beam while power is being supplied to said microfocus X-ray tube;

(d) a target anode; and (e) third means for causing relative movement of the electron beam and said target anode such that the electron beam and said target anode are stationary relative to each other during production of X-rays but a fresh portion of the surface of said target anode is presented to the electron beam each time the X-ray machine is used, the improvement wherein said third means causes motion of the electron beam.

28. In an X-ray machine as recited in claim 27, the further improvement wherein said X-ray tube further comprises fourth means for increasing the quantity of electricity delivered by said first means to said microfocus X-ray tube so that the total number of X-rays produced by said microfocus X-ray tube is at least approximately equal to the total number of X-rays which would be produced by a conventional microfocus X-ray tube when said first means was set for a given time period by the operator of the X-ray machine.

29. In an X-ray machine as recited in claim 28, the further improvement wherein said fourth means causes a higher current value to be supplied by said first means.

30. In an X-ray machine as recited in claim 27, the further improvement wherein said X-ray machine further comprises:

(a) fifth means for counting the number of times said X-ray tube has been used and (b) sixth means for generating a first signal when said X-ray tube has been used a predetermined number of times.

31. In an X-ray machine as recited in claim 30, the further improvement comprising seventh means for generating a second signal when said X-ray tube has been used a second predetermined number of times, which second predetermined number of times is greater than the first predetermined number of times.

32. In an X-ray machine as recited in claim 30, the further improvement comprising:

(a) eighth means for detecting when said target anode has been consumed and (b) ninth means for generating a second signal when said target anode has been consumed.

* * * * *